US008789722B2

(12) United States Patent
Reuthe

(10) Patent No.: US 8,789,722 B2
(45) Date of Patent: Jul. 29, 2014

(54) BEDDING BOX FOR USE WITH COMPACT EXCAVATOR

(71) Applicant: James T. Reuthe, Claremont, NH (US)

(72) Inventor: James T. Reuthe, Claremont, NH (US)

( * ) Notice: Subject to any disclaimer, the term of this patent is extended or adjusted under 35 U.S.C. 154(b) by 0 days.

(21) Appl. No.: 13/749,811

(22) Filed: Jan. 25, 2013

(65) Prior Publication Data

US 2013/0341332 A1 Dec. 26, 2013

Related U.S. Application Data

(60) Provisional application No. 61/663,848, filed on Jun. 25, 2012.

(51) Int. Cl.
*B65D 88/12* (2006.01)
*B65D 90/00* (2006.01)

(52) U.S. Cl.
CPC ..... *B65D 88/128* (2013.01); *B65D 88/123* (2013.01); *B65D 90/0033* (2013.01)
USPC ..... 220/628; 220/562; 220/646; 220/647; 220/673; 405/179

(58) Field of Classification Search
CPC .... B65D 88/12; B65D 88/121; B65D 88/123; B65D 88/128; B65D 88/129
USPC ..... 220/1.5, 628, 646, 647, 669, 670–673; 405/179
See application file for complete search history.

(56) References Cited

U.S. PATENT DOCUMENTS

| | | | | |
|---|---|---|---|---|
| 4,462,715 | A | 7/1984 | Ashbaugh | |
| 4,848,619 | A * | 7/1989 | Corompt | 220/1.5 |
| 5,367,796 | A | 11/1994 | Bowers et al. | |
| 7,306,273 | B2 * | 12/2007 | Estes | 294/68.1 |
| 7,402,003 | B2 * | 7/2008 | Kundel, Sr. | 405/283 |
| 7,473,068 | B2 | 1/2009 | Berentsen | |
| 2006/0104774 | A1 * | 5/2006 | Sessler et al. | 414/539 |
| 2010/0012667 | A1 * | 1/2010 | Powell | 220/628 |

OTHER PUBLICATIONS

FELCO Industries, "Bedding Boxes", published on the Internet at URL: http://www.felco-ind.com/products/bedding-boxes/.
Griswold Machine & Engineering, Inc., "GME Bedding Boxes", published on the Internet at URL: http://www.gme-shields.com/products/steel/bedding-box.

* cited by examiner

*Primary Examiner* — Fenn Mathew
*Assistant Examiner* — Madison L Poos
(74) *Attorney, Agent, or Firm* — Michael J. Weins; Jeffrey E. Semprebon

(57) ABSTRACT

A bedding box has a container formed by sloped end plates and side plates joined to a bottom plate, with gusseted wing plates reinforcing the side plates. The wing plates extend outwards from the container to facilitate loading. A frame attaches to each of the end plates, one frame having horizontally-extending, vertically-spaced apart bars to allow the bucket of a compact excavator to be wedged therebetween to lift the bedding box, while the other end serves to attach one or more support brackets that can be lifted by a scraper blade of the excavator, allowing support at both ends of the bedding box for transportation over uneven terrain. Skids can be affixed to the bottom plate to reinforce it, to facilitate dragging the bedding box, and to facilitate lifting the bedding box from one end with a forklift.

13 Claims, 6 Drawing Sheets

BEDDING BOX FOR USE WITH COMPACT EXCAVATOR

FIELD OF THE INVENTION

The present invention relates to a bedding box that can be employed to hold stone or similar material at a construction site, and particularly for a bedding box suitable for use at sites with limited space.

BACKGROUND OF THE INVENTION

Bedding boxes are employed as on-site storage containers for holding stone and other materials used in the course of bedding, grading, and related tasks at a construction site; these materials are frequently cleaned and sorted by size, and should be kept separate from surrounding materials to maintain their purity. These bedding boxes are large, massive boxes that frequently have a frame to add strength and rigidity, and terminate in an end frame that is configured to provide a passage into which the bucket of an excavator can be wedged. When the bucket is so wedged in the opening, the boom of the excavator can be raised and the bedding box is lifted by the bucket, and can then be moved around the site.

One of the difficulties of the currently available bedding boxes is that the engagement of the bedding box with the bucket of the excavator relies largely on friction to maintain the engagement. This can cause difficulty if the bedding box is being transported over substantial distances at the site. Since the boxes are typically very massive and have a frame which adds further weight, the weight serves to maintain the frictional engagement of the bucket with the box so that such slippage is often not a problem.

Such bedding boxes would be advantageous for use at smaller sites, since the confined nature of such sites makes the containment and removal of material more desirable to avoid spillage into the surrounding areas. However, in such areas it is preferred to use smaller excavators to increase the flexibility, and a corresponding reduction in the size of the bedding boxes would be desirable both because of the limited space and so that the bedding box can be manipulated by the smaller excavators. Currently, such small bedding boxes are not available. This may result from the fact that reducing the size of the bedding boxes would reduce their weight and this, in combination with smaller buckets of the compact excavators employed, would lower the frictional forces between the bucket and the bedding boxes. Furthermore, scaling down the boxes would result in a reduction in the cross-sectional area into which materials could be dumped.

Thus, there is a need for a bedding box of smaller size that can be reliably transported by smaller excavators operating on confined work sites and yet be as readily loaded as the larger bedding boxes.

SUMMARY OF THE INVENTION

The present invention is for a bedding box for storing bedding stone and similar materials at a construction site, and which is particularly useful for regions of the site where access is limited. The bedding box is configured to be useful for smaller, compact excavators of the type having a scraper blade, and is further configured so as to be readily transported by the excavator for substantial distances over highly irregular surfaces.

The bedding box has a container terminating in a distal end plate and a proximal end plate. The container is further bounded by side plates and a bottom plate. The distal end plate, the proximal end plate, and the side plates terminate in a container upper rim. Drain holes are preferably provided through the bottom plate to allow drainage of water.

Wing plates are attached to the side plates at the container upper rim and are canted with respect to the same by an angle ω to extend upward and outward from the container. Having the wing plates so placed provides two functions. The first function is to allow wider loading buckets to dump material into the bedding box without spillage; the wing plates similarly serve to help retain material in the box when pushed by scooping action of an excavator bucket removing material from the box. The second function is that, by having the wing plates canted, they form angle members with the side plates to increase the rigidity of the container and reduce buckling. Gussets are attached to the side plates and to the wing plates; these gussets not only increase the rigidity of the wing plates, but also serve to further stiffen the sidewalls.

A distal end frame is affixed to the distal end plate of the container. The distal end frame has a pair of uprights that are connected to a reinforcing bar that extends horizontally and is positioned at the container upper rim. The uprights terminate in upright free ends, and a substantially horizontal lift bar is affixed to the upright free ends, extending parallel to the reinforcing bar and spaced apart therefrom by a separation S. The region between the substantially horizontal lift bar and the reinforcing bar is open to allow the excavator bucket to be lodged therebetween, and the separation S is selected relative to the size of the expected excavator bucket to allow insertion and wedging of the excavator bucket between these members. This allows the box to be lifted from one end by an excavator bucket in a manner similar to that of a large conventional bedding box, allowing the excavator to reposition the box at the site while the excavator remains stationary; however, due to the relatively small size and weight of the box, lifting it from one end is frequently not sufficiently secure for transport when the excavator itself is moved from one location to another.

A proximal end frame is affixed to the proximal end plate of the container and is configured so as to reinforce the proximal end plate. In addition to supplying reinforcement of the proximal end plate of the container, the proximal end frame also allows attachment of one or more support brackets configured to be engagable with a scraper blade of the excavator. The support bracket(s) provide a downward-facing bearing surface that can rest atop the scraper blade to be supported thereon, thereby providing support for the bedding box in combination with support by the excavator bucket engaging the distal end frame when the bedding box is to be transported by the excavator. When the bedding box is supported at both ends in such manner, it can be securely transported by the excavator moving from one location to another without risk of being dislodged by the movement of the excavator.

The bedding box is also provided with at least two skids residing below the bottom plate and substantially spanning the distance between the proximal end plate and the distal end plate. These skids serve two functions; first, they allow easier movement over the terrain on which the bedding box resides, and second, they enhance the rigidity of the bottom plate thereby further strengthening the bedding box. The height and spacing of the skids can be set to accommodate the tines of a forklift, allowing the bedding box to be lifted if the weight distribution is set so as to allow the box to balance on the forklift tines. The mass of the distal end frame is sufficiently large that the bedding box can be readily configured to allow it to be lifted by a forklift positioned at the distal end.

In some embodiments, wear bars reside in the container and attach to the proximal and distal ends and to the bottom plate. These wear bars prevent damage to the bottom and end plates of the container, as well as to provide strengthening of the bottom plate against the forces resulting from loading the box.

It is preferred for an angle δ to be maintained between the distal end frame (and the distal end plate to which it is affixed) and a line normal to the bottom plate, and similarly for the proximal end plate to be inclined by an angle π. These angles allow material loaded into the container to flow to the bottom while providing a greater area into which material can be dumped from a loader scoop or similar implement, without increasing the length of the bottom plate. The angle of the distal end frame may also simplify the insertion of the excavator bucket between the lift bar and the lower reinforcing bar.

With regard to the support bracket(s), various configurations can be employed. As noted above, the support bracket has a downward-facing bearing surface for resting atop the scraper blade. Preferably, a lip element that extends below this support surface to engage the top of the scraper blade is also provided so as to resist any tendency to slip off the scraper blade. A single wide support bracket should avoid tilting of the box or, alternatively, multiple spaced-apart support brackets can be employed. In all cases, the support brackets should be affixed with respect to the proximal end frame.

DETAILED DESCRIPTION OF THE PREFERRED EMBODIMENTS

Figure 1:
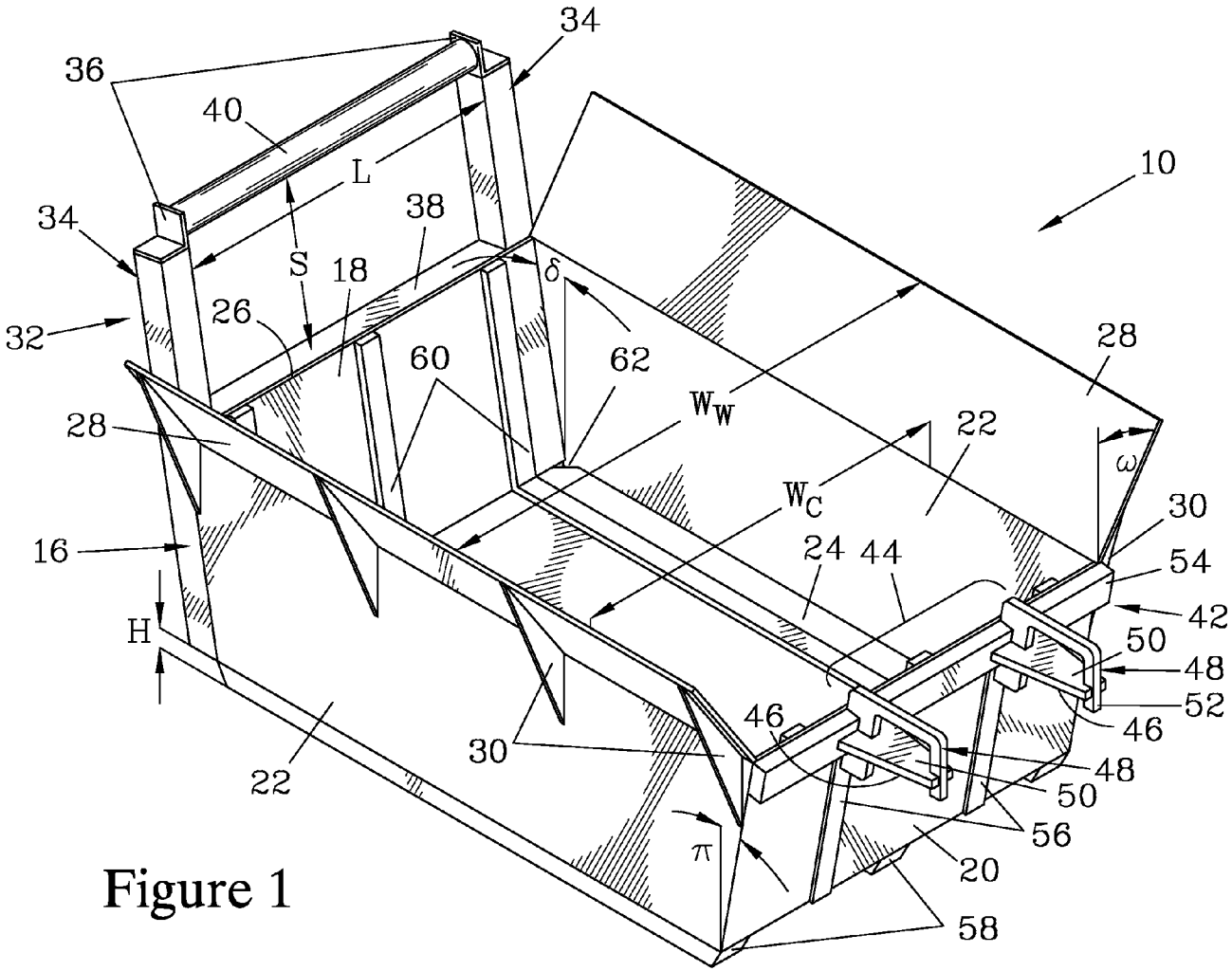
FIG. 1 is an isometric view illustrating a bedding box that forms one embodiment of the present invention. The bedding box has a container, formed by distal and proximal end plates, side plates, and a bottom plate. Wing plates are attached to the side plates and extend upwards and outwardly therefrom. Additionally, a series of gussets are affixed to both the wing plates and the side plates. A distal end frame attached to the distal end plate provides a pair of spaced apart bars that can be engaged by an excavator bucket to lift the bedding box, while a proximal end frame attached to the proximal end plate has a pair of support brackets affixed thereto to support one end of the bedding box on a scraper blade of the excavator. Three skids are affixed beneath the bottom plate to support the bedding box on uneven terrain, to reduce friction to allow the bedding box to be pushed or pulled into position over the ground, and to allow the tines of a forklift truck to be inserted below the bottom plate to lift the bedding box.

FIG. 1 is an isometric view that illustrates one embodiment of the present invention, a bedding box 10 which is designed to be suitable for use with compact excavators. Such compact excavators typically have a bucket 12 (shown in FIG. 2), having a bucket width $W_B$, mounted to a boom (not shown), and a scraper blade 14 (shown in FIG. 3) mounted to the chassis of the excavator (not shown). The bedding box 10 is designed for holding bedding fill such as washed and graded stone, which can be removed from the bedding box 10 by the excavator and dropped at the appropriate position.

The bedding box 10 has a container 16 which terminates in a distal end plate 18 and a proximal end plate 20. The container 16 is further bounded by side plates 22 and a bottom plate 24. The distal end plate 18, the proximal end plate 20, and the side plates 22 terminate in a container upper rim 26 defined by the top edges of these plates (18, 20, 22). It is preferred that the distal end plate 18 be canted with respect to the vertical at an angle δ measuring between about 20° and 25° to facilitate loading the container 16 with a conventional front loader approaching from one of the sides. Similarly, it is preferred for the proximal end plate 20 to be inclined by an angle π of between about 20° and 25°.

Wing plates 28 are attached to the side plates 22 and are canted with respect thereto by an angle ω so as to extend upward and outward from the container 16. The angle ω is preferably in range of about 40-55°, and more preferably about 45°. Support gussets 30 are attached between the side plates 22 and the wing plates 28. These support gussets 30 enhance the rigidity of both the side plates 22 and the wing plates 28; in addition to providing direct support against buckling of the individual plates (24, 28), the rigid connection of the wing plates 28 to the side plates 22 creates an angled structure which further resists any buckling of the overall structure.

To further assure sufficient rigidity of the container 16, it is preferred that the plates (18, 20, 22, 24, 28) be fabricated from sheet metal at least about 10 gauge, and to maintain a reasonably low weight, not more than about 3/16" thick.

A distal end frame 32 attaches to the distal end plate 18 of the container 16 and extends above the container 16. The distal end frame 32 has a pair of parallel uprights 34 terminating in a pair of upright free ends 36; in this embodiment, the upright free ends 36 are formed by angle brackets affixed to rectangular tube stock that forms the uprights 34. It should be appreciated that other cross sections could be chosen for the uprights, such as L-shaped or circular; however, square tubular stock is felt to provide a desirable degree of strength and rigidity and eases fabrication by welding. The distal end frame 32 also has a reinforcing bar 38 which has a length L that is greater than the bucket width $W_B$ of the bucket 12 (shown in FIG. 2), and which extends substantially horizontally. The reinforcing bar 38 is positioned adjacent to the container upper rim 26. The distal end frame 32 also has a substantially horizontal lift bar 40 that attaches to the free ends 36 of the uprights 34 so as to extend parallel to the reinforcing bar 38. The lift bar 40 is spaced apart from the reinforcing bar 38 by a separation S. This separation S is selected to allow the excavator bucket 12 to be wedged between the bars (38, 40), which allows the excavator bucket 12 to lift the bedding box 10 from one end as illustrated in FIG. 2.

Figure 2:
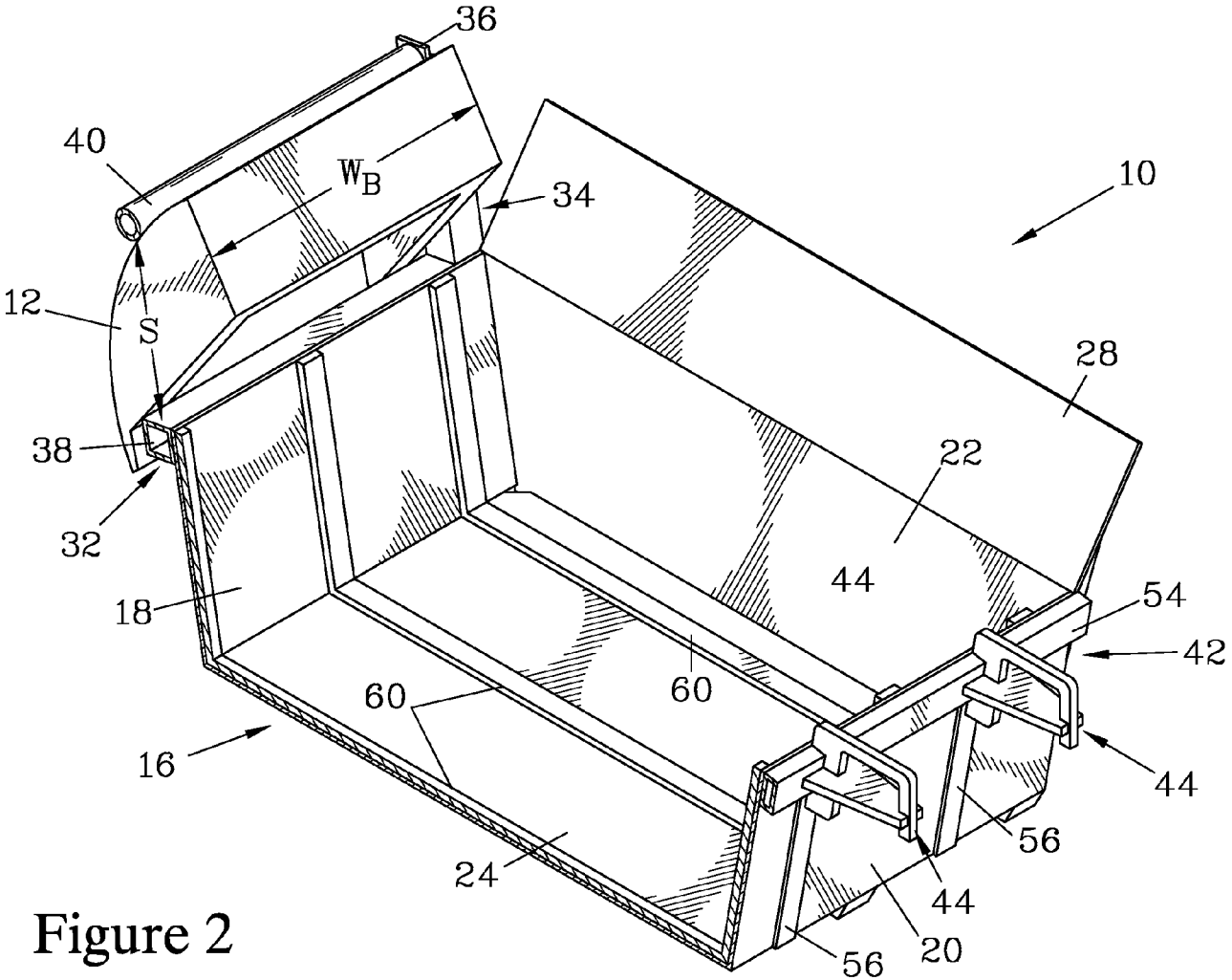
FIG. 2 is an isometric view of the bedding box shown in FIG. 1 when lifted from the distal end by an excavator bucket which, as illustrated, is a relatively wide bucket such as is typically used for filling and grading operations. The bucket is inserted into the rectangular space formed by the distal end frame and bounded at the bottom by a reinforcing bar, at the top by a lift bar, and at the sides by uprights. After insertion, the bucket is then angled so as to engage the inner side of the lift bar and the outer edge of the reinforcing bar. Such engagement effectively creates a fulcrum along the line of engagement between the reinforcing bar and the bucket, with the weight of the bedding box creating a torque to force the lift bar tightly against the bucket and allowing the bucket to lift the bedding box from the distal end.

FIG. 2 illustrates a cross section of the bedding box 10 and illustrates details of the engagement of the bucket 12 with the distal end frame 32. The bucket 12 illustrated has the bucket width $W_B$ which is relatively large, thus making the bucket 12 suitable for distributing material scooped from the container 16. The container 16 is sized such that the side plates 22 are spaced apart by a container width $W_C$ (shown in FIG. 1) that is somewhat greater than the greatest bucket width $W_B$ that is expected to be used with the bedding box 10. Having the wing plates 28 sloping upward allows material to be scooped from container 16 without spillage over the container rim 26 as the material is pushed by the scooping action, while sloping outwards results in a wing maximum width $W_W$ (also shown in FIG. 1) that is significantly greater than the container width $W_c$. The wing maximum width $W_W$ should be somewhat greater than the width of a loader scoop used to fill the container 16 with bedding material when it is in the desired location; this allows the loader to fill the container 16 from one end while material is scooped from the container 16 by the excavator located at the other end to be used to fill and grade the worksite. The preferred range for the angle ω of about 40-55°, and more preferably about 45°, is felt to provide a desirable compromise between gaining height (which prevents overflow of material as it is pushed by the action of the excavator bucket 12 scooping material from the container 16) and gaining width (to assure that the wing maximum width $W_W$ at the top is greater than the largest width of loader scoop expected to be used to fill the container 16).

The separation S between the bars (38, 40) is set such that the bucket 12 can be inserted therebetween and subsequently rotated such that the bucket 12 frictionally engages the bars (38, 40), to provide the engagement illustrated in FIG. 2.

Figure 3:
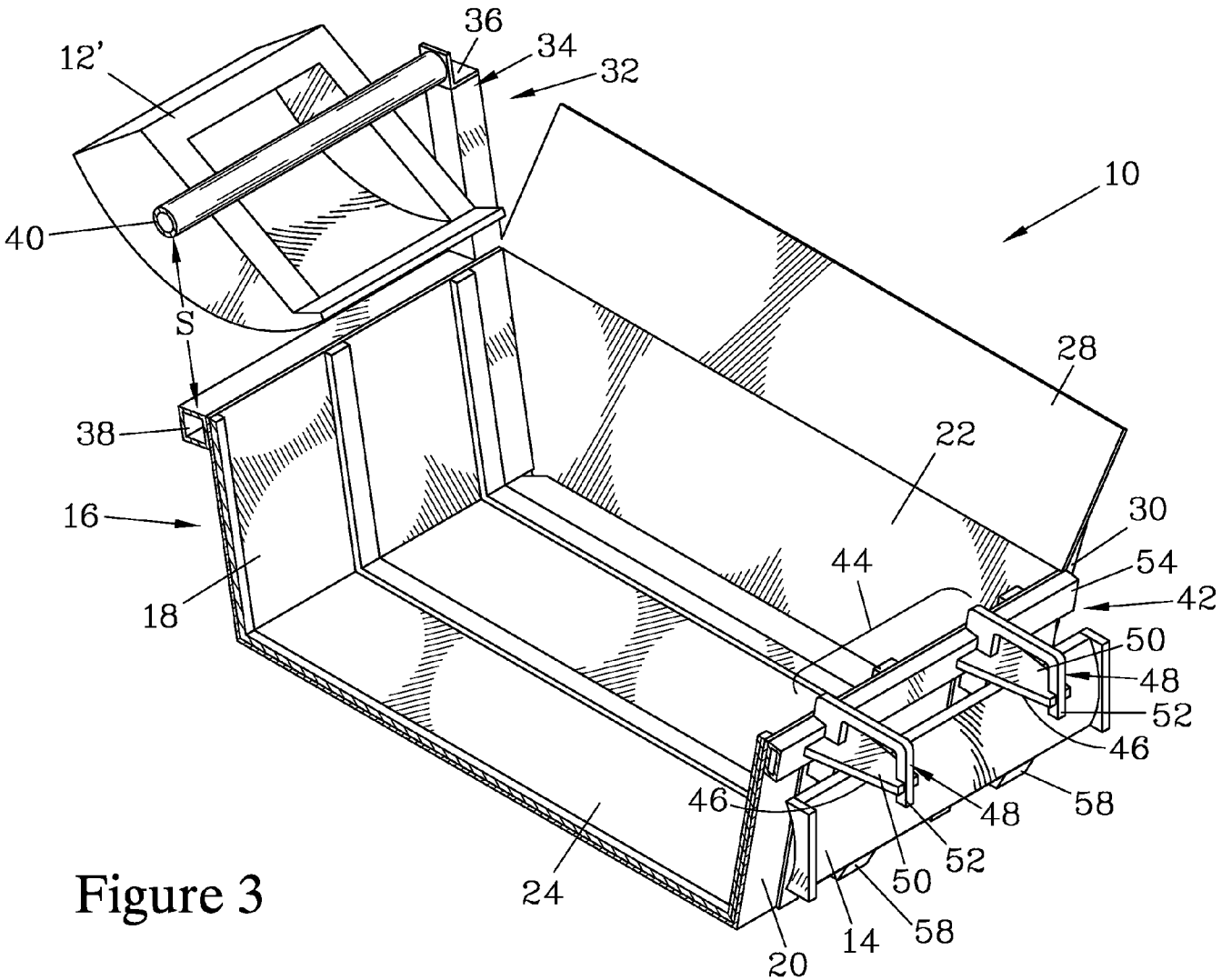
FIG. 3 is an isometric view of the bedding box shown in FIGS. 1 and 2 when supported at both ends by the excavator. At the distal end, the bedding box is again supported by an excavator bucket; however, the bucket shown in FIG. 3 is a relatively narrow bucket, such as is typically used for digging trenches. As shown, the bucket is not wedged between the lift bar and the reinforcing bar, but rather only engages the lift bar. At the proximal end, the bedding box is supported by the support brackets, which rest atop the scraper blade of the excavator. The bucket is positioned to engage the outer edge of the lift bar, effectively trapping the bedding box between the bucket and the scraper blade. Such support at both ends is not dependent on the weight of the bedding box to maintain it engaged with the bucket, and thus provides more secure support for the bedding box that is suitable for transporting it while traversing uneven terrain where vibrations might result in disengagement if the bedding box were supported from only one end, as shown in FIG. 2.

The container 16 is also provided with a proximal end frame 42 which attaches to the proximal end plate 20 of the container 16. At least one support bracket 44 is affixed with respect to the proximal end frame 42 and has a downward-facing bracket bearing surface 46 positioned to be engageable with the scraper blade 14 of the excavator, as shown in FIG. 3. This support bracket 44 allows the container 16 to be securely supported at the proximal end by the scraper blade 14 of the excavator and at the distal end by the bucket 12 of the excavator; since this support is not dependent on frictional forces between the bucket 12 and the distal end frame 32 to lift the bedding box 10, it allows secure transportation of the bedding box 10 by the excavator for considerable distances and over uneven terrain.

In the embodiment shown in FIG. 1, two support brackets 44 are attached to the proximal end frame 42. Each support bracket 44 has a substantially vertical brace 48, which is affixed to the proximal end frame 42, and a bracket bearing member 50 that is affixed to the substantially vertical brace 48, and on which the bracket bearing surface 46 is provided. The substantially vertical braces 48 extend below the bracket bearing surface members 50 to provide bracket lips 52 that are spaced apart from the proximal end frame 42 to aid in retaining the support brackets 44 engaged with the scraper blade 14. The bracket bearing members 50 not only provide the bracket bearing surface 46 at the desired height, but also serve as horizontal reinforcing braces for the substantially vertical braces 48 to strengthen the support brackets 44.

In the embodiment illustrated in FIGS. 1-3, the proximal end frame 42 has a substantially horizontal proximal end frame top bar 54 that attaches to the proximal end plate 20 and resides in close proximity to the container upper rim 26, and a pair of proximal end frame risers 56 which are attached to the proximal end plate 20 and extend up to the proximal end frame top bar 54. The substantially vertical braces 48 are affixed to both the proximal end frame top bar 54 and the proximal end frame risers 56.

Figure 5:
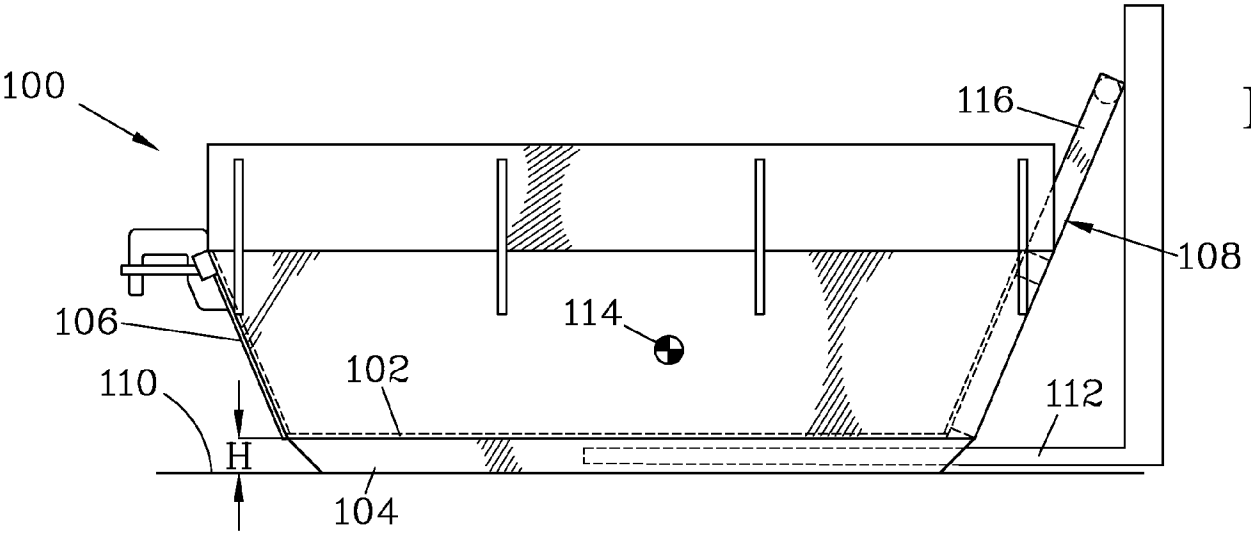
FIG. 5 is a side view showing a bedding box of the present invention resting on the ground in a position to be engaged by the tines of a forklift truck. The bedding box rests on skids having a skid height H that is sufficient to allow the tines to be inserted beneath the bottom plate, between the skids.
Figure 6:
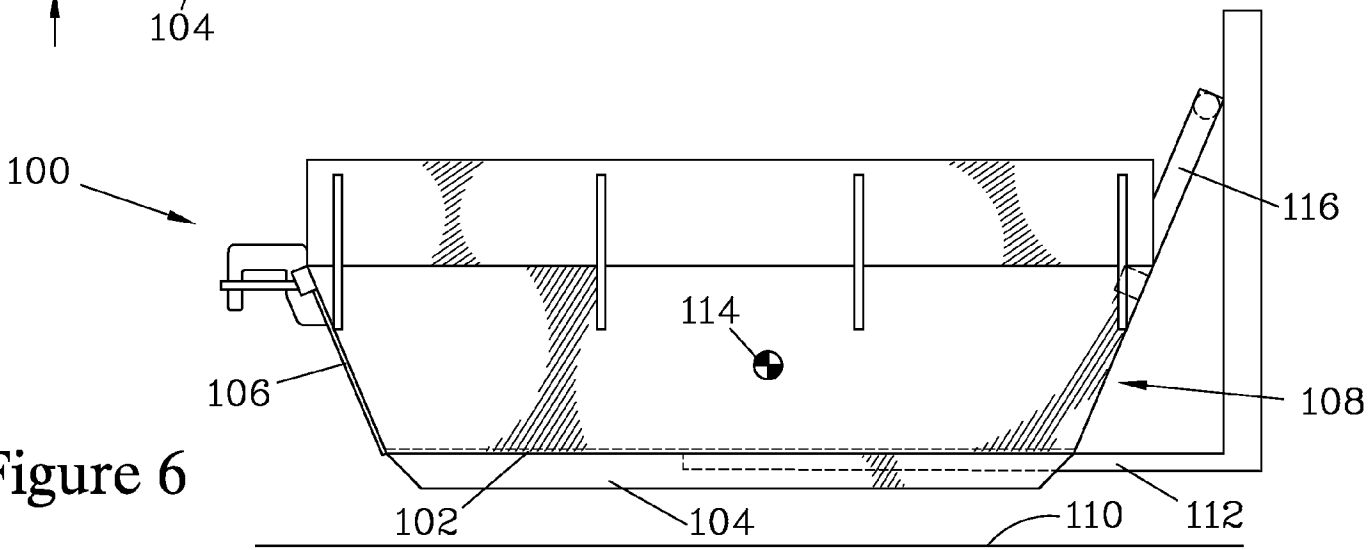
FIG. 6 shows the bedding box and forklift tines shown in FIG. 5 when the tines have been lifted to support the bedding box thereon, such as to lift the bedding box onto a flatbed trailer or truck for transport. Since the structure of the distal end frame is more massive than that of the proximal end frame, the center of gravity of the bedding box is displaced somewhat towards the distal end. The bedding box is configured such that, when engaged by forklift tines from the distal end, its center of gravity resides over the tines, allowing the tines to support the bedding box thereon.

At least two skids 58 are affixed to the bottom plate 24, and extend therealong between the distal end plate 18 and the proximal end plate 20. The skids 58 can be fabricated by cutting and bending sheet stock, or can be cut from rectangular tube stock. Preferably, the skids 58 are at least about three inches thick so as to raise the bottom plate 24 by a skid height H to allow the tines of a forklift truck to pass between the skids 58 under the bottom plate 24 when the skids 58 rest on a surface (as shown in FIGS. 5 and 6, discussed below).

To provide increased durability and rigidity, the container 16 is provided with wear bars 60 that are affixed to and traverse the distal end plate 18, the bottom plate 24, and the proximal end plate 20. These wear bars 60 serve primarily to prevent damage to the plates (18, 20, 24) by the bucket 12 when material is scooped from the container 16, but additionally provide further reinforcement of the plates (18, 20, 24). The wear bars 60 can be made from ¼" thick bar stock.

The bottom plate 24 can be provided with drainage passages 62 (only one of which is shown) that are positioned near the corners where the bottom plate 24 joins the distal end plate 18 and the side plates 22 and where the bottom plate 24 joins the proximal end plate 20 and the side plates 22.

FIG. 2 illustrates the engagement between the excavator bucket 12 and the distal end frame 32 that allows the bucket 12 to lift the bedding box 10 in order to reposition it at a worksite. The manner of lifting is similar to that employed to lift conventional bedding boxes by large excavators, and relies on frictional forces to maintain the bedding box engaged with the bucket.

To lift the bedding box 10 from one end, the excavator bucket 12 is inserted from a position residing over the container 16 into the space between the reinforcing bar 38 and the lift bar 40, and then rotated about a nominally horizontal axis to wedge the bucket 12 against an outer edge of the reinforcing bar 38 and against an inner side of the lift bar 40. When so engaged, the reinforcing bar 38 can be considered as a fulcrum, with the weight of the bedding box 10 creating a torque about the line of engagement between the bucket 12 and the reinforcing bar 38. This torque forces the lift bar 40 against the bucket 12, which blocks rotation of the bedding box 10 and results in frictional forces between the bucket 12 and the bars (38, 40) to maintain the bedding box 10 engaged with the bucket 12 and allowing it to be lifted by the excavator to be repositioned by moving the bucket 12 to the desired new position for the bedding box 10. While the bucket 12 is shown in FIG. 2 with its open side facing the container 16, it is also possible for the bucket 12 to be inserted with its open side facing away from the container 16 and still be rotated into a position where the distal end frame 32 is securely wedged onto the bucket 12.

While the frictional engagement force may often be sufficient for repositioning the bedding box 10 short distances about the worksite, the small size of the bedding box 10 limits the magnitude of the frictional forces. Thus, unlike conventional large bedding boxes where the massive weight of the bedding box allows it to be secured to the bucket of a large excavator by frictional forces alone, in the bedding box 10 such forces may not provide secure engagement if the bedding box 10 must be repositioned longer distances, and particularly if the compact excavator must traverse uneven terrain to move the bedding box 10 to the desired new location. For such traverses, the bedding box 10 is supported from both ends, as shown in FIG. 3. Support from both ends may also be desirable when the excavator is fitted with a narrow digging bucket 12', such as shown in FIG. 3, which has a reduced width that offers less surface for frictional engagement with the distal end frame 32.

FIG. 3 shows the bedding box 10 when supported at one end by the narrow bucket 12', and at the other end by the scraper blade 14 of the excavator. In this case, the bucket 12' can be inserted into the space between the reinforcing bar 38 and the lift bar 40 from outside the container 16, and engaged with an outer side of the lift bar 40. The excavator blade 14 is brought underneath the bracket bearing surface 46 of the support brackets 44 and lifted into engagement with the bracket bearing surface 46, at which time raising the blade 14 further causes it to lift that end of the bedding box 10 via the support brackets 44. The bedding box 10 is then supported at both ends, by the engagement of the bucket 12' with the lift bar 40 and by the engagement of the blade 14 with the support brackets 44. Movement of the bracket bearing surface 46 which might cause it to slide off the blade 14 is blocked in one direction by the proximal end frame 42 and/or the support brackets 44, and in the other direction by the engagement of the bucket 12' with the lift bar 40. Alternatively, motion of the blade 14 away from the container 16 can be limited by the bracket lips 52; this should provide additional security in the event that the bedding box 10 is transported down a grade, since the bracket lips 52 block slippage of the bracket bearing surface off of the blade 14 without relying on constant restraint by the arm of the excavator that supports the bucket 12'. In all cases, since the bedding box 10 is supported at both ends and is not dependent on friction to maintain the engagement with the supporting elements of the excavator, the bedding box 10 can be securely transported for longer distances over uneven terrain to relocate it to a desired new position.

Figure 4:
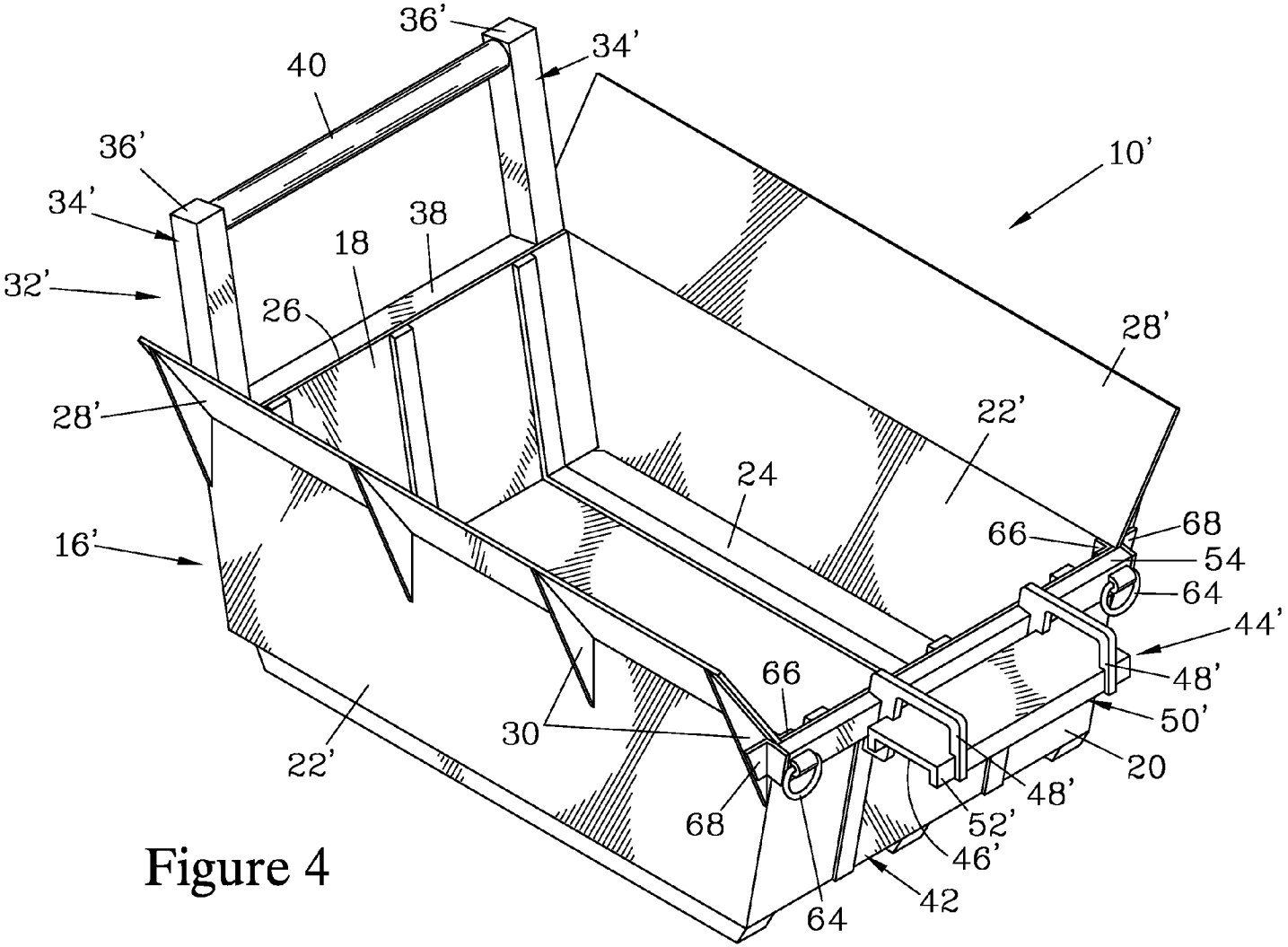
FIG. 4 is an isometric view of a bedding box that forms another embodiment of the present invention, and which shares many features in common with the bedding box shown in FIGS. 1-3, but which differs in some details of its construction. The bedding box has a single support bracket attached to the proximal end frame, thereby providing a single extended surface for supporting the proximal end of the bedding box atop the scraper blade of an excavator. The proximal end plate of this embodiment is reinforced by outer corner braces, which affix together the proximal end frame, the proximal end plate, one of the side plates, and one of the gussets that in turn affixes one of the wing plates to the side plate. The attachment of the proximal end plate to the side plates is further reinforced by inner corner braces that affix these elements together. The attachment of the distal end plate to the side plates is reinforced by affixing the side plates directly to the uprights of the distal end frame, such that the uprights serve as angular braces between the plates. This embodiment is also equipped with D-rings attached to both frames, to provide anchor points to secure the bedding box to a flatbed trailer or truck body with ropes or chains for transportation.

FIG. 4 is an isometric view of a bedding box 10' that forms another embodiment of the present invention, which shares many features in common with the bedding box 10 discussed above, but which differs in some details of its construction. The bedding box 10' has features that may offer greater rigidity, and has anchoring rings 64 at each end to allow the bedding box 10' to be secured on a flatbed trailer or truck body by ropes or chains for transport to a new worksite. The anchoring rings 64 can be provided by D-rings that are mounted to a distal end frame 32' and the proximal end frame 42.

The bedding box 10' has a container 16' with side plates 22', in this embodiment, the side plates 22' extend beyond the distal end plate 18. This extension allows the side plates 22' to be affixed directly to uprights 34' of the distal end frame 32', thereby allowing the uprights 34' to also serve as angle braces to reinforce the joint between the side plates 22' and the distal end plate 18. The wing plates 28' are extended to be coextensive with the side plates 22'. The distal end frame 32' differs in the configuration of the uprights 34', which are again formed of rectangular tube stock, but which extend somewhat higher than the uprights 34 shown in FIGS. 1-3 so as to provide the upright free ends 36', to which the lift bar 40 is directly affixed.

The joint between the side plates 22' and the proximal end plate 20 is reinforced by inner corner braces 66 and outer corner braces 68 that affix these plates (20, 22') together. The outer corner braces 68 can also affix to the proximal end frame top bar 54 and to the gussets 30 that reside closest to the proximal end plate 20.

The bedding box 10' also differs in having a single support bracket 44' affixed to the proximal end frame 42 to allow that end of the bedding box to be lifted by the scraper blade 14 (shown in FIG. 3 engaged with the bedding box 10) of the excavator. The support bracket 44 again has a pair of substantially vertical bracket supports 48' that are affixed to the proximal end frame 42. A single bracket bearing member 50' is affixed to both of the bracket supports 48', and provides both a downward-facing bracket bearing surface 46' and a bracket lip 52'.

FIGS. 5 and 6 illustrate a bedding box 100 which can be essentially similar to either of the bedding boxes (10, 10') discussed above. The bedding box 100 has a bottom plate 102 supported on skids 104, and terminates at a proximal end 106 and a distal end 108. The skids 104 serve to raise the bottom plate 102 above a ground surface 110 by a skid height H that is preferably between about three and four inches. This height of the bottom plate 102 allows tines 112 of a forklift truck (not shown) to be readily inserted under the bottom plate 102 from the distal end 108.

The bedding box 100 is configured so as to have a center of gravity 114 that is located close enough to the distal end 108 to reside over the tines 112 when inserted from the distal end 108, as shown in FIG. 6. The center of gravity 114 of the bedding box 100 is typically displaced towards the distal end 108 by the weight of a distal end frame 116, and thus in most cases the forklift can securely lift the bedding box 100 from the distal end 108, but not from the proximal end 106.

Once the tines 112 have been inserted, they can be lifted into engagement with the bottom plate 102 to support the bedding box 100 on the tines 112. The bedding box 100 can then be placed onto a flatbed trailer or truck bed for transport to a new location.

Figure 7:
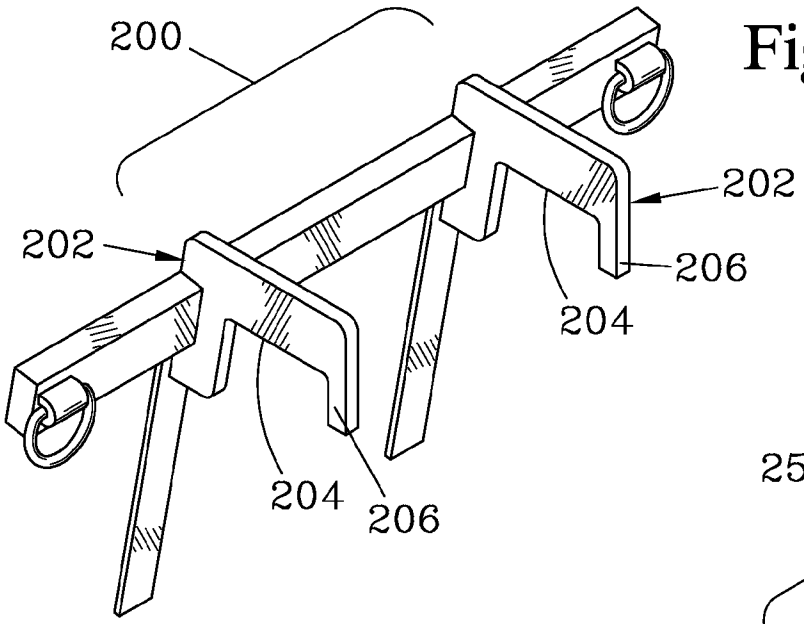
FIG. 7 is an isometric view of an alternative pair of support brackets that can be affixed to the proximal end frame in place of the brackets shown in either FIGS. 1-3 or FIG. 4. The support brackets are formed only by a pair of substantially vertical bracket supports, each of which is formed with a downward-facing bracket bearing surface.

FIG. 7 is an isometric view that illustrates an alternative pair of support brackets 200 which can be employed in place of either the support brackets 44 of the embodiment shown in FIGS. 1-3 or the support bracket 44' shown in FIG. 4. The pair of support brackets 200 are provided only by a pair of substantially vertical bracket supports 202, each of which is configured to provide a bracket bearing surface 204 adjacent to a bracket lip 206 that extends below the bracket bearing surface 204.

Figure 8:
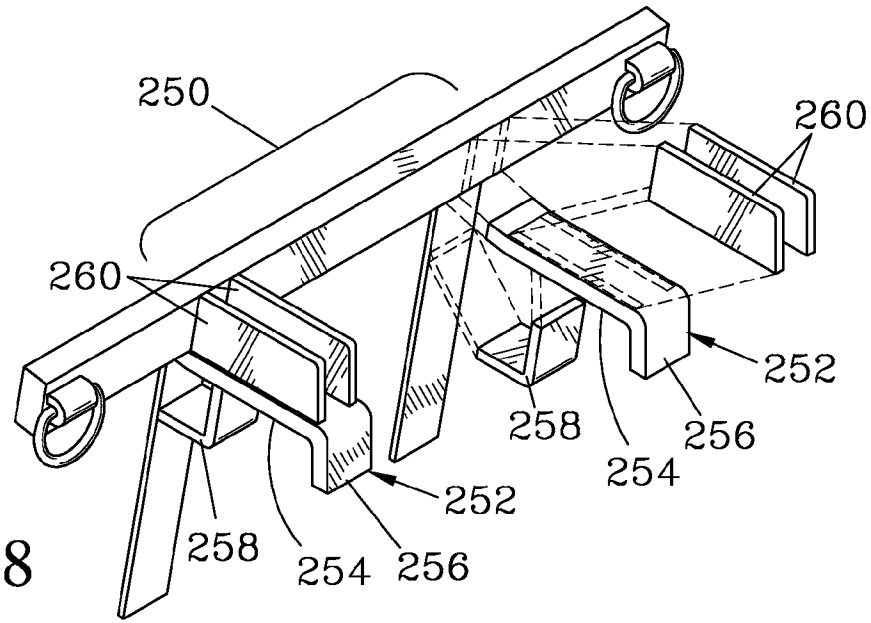
FIG. 8 is an isometric view of another alternative pair of support brackets; these brackets can be fabricated from bar stock to eliminate any requirement for using shaped pieces, thereby facilitating fabrication of the support brackets.

FIG. 8 illustrates another alternative pair of support brackets 250, which are designed to facilitate fabrication by eliminating any need for shaped cutting when forming the components of the support brackets 250; one of the support brackets 250 is shown exploded to better illustrate its components, which can all be cut to length and bent from readily available bar stock. Each of the support brackets 250 has a bracket bearing member 252 which is bent to provide a substantially horizontal bracket bearing surface 254 and a bracket lip 256. The bracket bearing member 252 is supported by an L-shaped bracket lower support 258, and is reinforced by a pair of upper bracket plates 260.

EXAMPLE

A bedding box having a configuration similar to the embodiments shown in FIGS. 1-4 was constructed for use with a 12,000 lb. excavator. The end, side, bottom, and wing plates were fabricated from 10 gauge steel to create a container with a container width $W_C$ of about 4'8" and a length at the bottom of 6'5". The end plates were sloped at about 25°, and the container had a height of about 2', resulting in a length at the container rim of about 7'6". The wing plates were 1' wide, and angled at 45° to provide a wing maximum width $W_W$ of about 6'. The wing plates were supported by gussets also formed from 10 gauge stock. Wear bars of 3"×¼" bar stock were added inside the container.

The distal end frame was constructed of 3" square tubular stock, with the lift bar formed of 3" round tube. The separation S between the lift bar and the reinforcing bar was 20½". While this separation was found to be satisfactory for the 12,000 lb. excavator, it was found to be too large for the bucket of a 9,500 lb. excavator. An additional piece of 3" square tube was added (serving as a new reinforcing bar) to reduce the separation 5 to 17½", and this separation was found suitable for use by both excavators.

The proximal end frame was fabricated with a top bar of 4"×1¾" rectangular tube and risers of 4"×¼" bar stock. Support brackets similar to those shown in FIGS. 1-3 were formed of ¾" thick plate, extending about 1' out from the container. The bracket bearing members were positioned to place the bracket bearing surface about 22" above the ground surface, taking into account the skid height H which was 4". Inner and outer corner braces of ¼" stock were employed.

The skids were formed of cut and folded 10 gauge sheet stock, but could alternatively be formed from rectangular tube stock. In the example, three skids 4" high and 5½" wide were employed.

The resulting bedding box weighed about 850 lbs. when empty, and the container was sized small enough to fit onto the bed of a conventional small (one-ton) truck. The balance of the bedding box was such that it could be lifted by a forklift if the tines were inserted from the distal end.

In an otherwise similar embodiment, support brackets such as those shown in FIG. 8 were employed. The bearing members were formed from ¾ inch thick bar stock, the lower supports were formed from ⅜ inch bar stock, and the upper bracket plates were formed from ½ inch bar stock.

While the novel features of the present invention have been described in terms of particular embodiments and preferred applications, it should be appreciated by one skilled in the art that substitution of materials and modification of details can be made without departing from the spirit of the invention.

What I claim is:

1. A bedding box for storing bedding stone and being configured to be transported by an excavator having a bucket with a bucket width ($W_B$) and having a scraper blade, the bedding box comprising:

a container terminating in a distal end plate and a proximal end plate, said container being further bounded by side plates and a bottom plate, said distal end plate, said proximal end plate, and said side plates terminating at a container upper rim;

wing plates affixed to said side plates at said container upper rim and being canted with respect to the same by an angle (ω) so as to extend upward and outward from said container;

gussets affixed to said side plates and said wing plates;

a distal end frame attached to said distal end plate of said container, said distal end frame extending above said container and having, a pair of uprights terminating in upright free ends, a reinforcing bar having a length (L) that is greater than the bucket width ($W_B$), said reinforcing bar traversing between said uprights, said reinforcing bar extending substantially horizontally and being positioned adjacent said container upper rim, and a substantially horizontal lift bar that attaches to said upright free ends, said lift bar extending parallel to and residing above said reinforcing bar and being spaced apart therefrom;

a proximal end frame attached to said proximal end plate of said container;

at least one support bracket affixed to said proximal end frame and having a downward-facing bracket bearing surface positioned to be engagable with the scraper blade of the excavator to allow said at least one support bracket to be supported thereon; and at least two skids having a skid height (H) and residing below said bottom plate and substantially spanning between said distal end plate and said proximal end plate.

2. The bedding box of claim 1 further comprising:

wear bars residing in said container and attached to said proximal end plate, said distal end plate, and said bottom plate.

3. The bedding box of claim 2 wherein said distal end plate is canted outwards at an angle (δ) with respect to a vertical plane so as to increase its separation from said proximal end plate with increasing elevation above said bottom plate.

4. The bedding box of claim 3 wherein said proximal end plate is canted outwards at an angle ($\pi$) with respect to a vertical plane.

5. The bedding box of claim 1 wherein said at least one support bracket further comprises:

a pair of substantially vertical bracket supports;

at least one bearing member affixed to said pair of bracket supports, said bracket bearing surface being formed by a bottom surface of said at least one bearing member; and a bracket lip adjacent to said bracket bearing surface and extending downwardly therebeyond, said bracket lip being spaced apart from said proximal end plate; and further wherein said proximal end frame comprises:

a proximal end frame top bar affixed to said proximal end plate and extending substantially horizontally so as to be positioned adjacent said container upper rim; and a pair of proximal end frame risers affixed to said proximal end plate and extending upwards from a bottom edge thereof to said proximal end frame top bar, each of said bracket supports being affixed to one of said proximal end frame risers.

6. The bedding box of claim 5 further comprising:

a pair of anchoring members attached to each of said frames to allow the bedding box to be secured onto a flatbed trailer or truck by ropes or chains.

7. The bedding box of claim 4 wherein the angle ($\omega$) of said wing plates is between about 40° and 55° .

8. The bedding box of claim 7 intended for use with excavators up to about 12,000 lbs., wherein said lift bar and said reinforcing bar are spaced by a separation (S) measuring between about 17 and 21 inches to allow the excavator bucket to be wedged therebetween to allow the excavator bucket to lift the bedding box.

9. The bedding box of claim 8 wherein said distal end plate, said proximal end plate, said bottom plate, said side plates, and said wings are formed from sheet stock having a thickness of at least about 10 gauge.

10. The bedding box of claim 9 further configured such that the center of gravity is located less than four feet from said distal end frame.

11. The bedding box of claim 9 wherein said side plates are affixed directly to said uprights.

12. The bedding box of claim 11 further comprising:

inner corner braces affixed to said proximal end plate and to each of said side plates; and outer corner braces affixed to said proximal end plate, said proximal end frame, and each of said side plates.

13. The bedding box of claim 12 wherein said bottom plate is provided with drainage holes.

* * * * *